US009457975B2

(12) United States Patent
Iesaki

(10) Patent No.: US 9,457,975 B2
(45) Date of Patent: Oct. 4, 2016

(54) CONTROL APPARATUS

(71) Applicant: BROTHER KOGYO KABUSHIKI KAISHA, Nagoya-shi, Aichi-ken (JP)

(72) Inventor: Kenichi Iesaki, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/661,229

(22) Filed: Mar. 18, 2015

(65) Prior Publication Data

US 2015/0277394 A1 Oct. 1, 2015

(30) Foreign Application Priority Data

Mar. 31, 2014 (JP) ..... 2014-072519

(51) Int. Cl.

*B65H 7/20* (2006.01)
*B65H 5/06* (2006.01)
*B65H 7/08* (2006.01)

(52) U.S. Cl.

CPC ..... *B65H 7/20* (2013.01); *B65H 5/062* (2013.01); *B65H 7/08* (2013.01); *B65H 2511/20* (2013.01); *B65H 2511/212* (2013.01); *B65H 2513/11* (2013.01); *B65H 2553/51* (2013.01); *B65H 2557/24* (2013.01)

(58) Field of Classification Search

CPC ..... B65H 7/20; B65H 5/00; B65H 5/06; B65H 7/02; B65H 5/062; B65H 7/00; B65H 29/125; B65H 43/00; B65H 2553/51

See application file for complete search history.

(56) References Cited

U.S. PATENT DOCUMENTS

2006/0076920 A1 4/2006 Muroi et al.
2010/0059926 A1* 3/2010 Terada ..... B41J 13/0018 271/10.09
2010/0245449 A1 9/2010 Koga et al.
2013/0256985 A1* 10/2013 Samoto ..... B65H 5/062 271/225
2013/0278664 A1* 10/2013 Arakane ..... B41J 23/04 347/16
2014/0167346 A1* 6/2014 Iijima ..... B65H 5/26 271/3.15
2014/0291926 A1* 10/2014 Iesaki ..... B65H 5/06 271/265.02

FOREIGN PATENT DOCUMENTS

JP 2006109544 A 4/2006
JP 2006243547 A 9/2006
JP 2007161389 A 6/2007
JP 2007183255 A 7/2007
JP 2010-234757 A 10/2010
JP 2011242286 A 12/2011

* cited by examiner

*Primary Examiner* — David H Bollinger
(74) *Attorney, Agent, or Firm* — Merchant & Gould P.C.

(57) ABSTRACT

A control apparatus includes: a motor; a driving body rotated by the motor; a rotary encoder including a disk and a sensor; a detector detecting a rotation position and a rotation velocity of the disk based on a signal outputted from the sensor; and a controller. The disk is fixed to the driving body in a state of being eccentric to a rotational axis of the driving body, and the sensor reads a scale of the disk and outputs a pulse signal depending on rotation of the disk. The controller generates velocity data indicating a locus of the rotation velocity with respect to the rotation position; specifies a position-phase relation between the rotation position of the disk and a rotation phase of the driving body; and controls at least one of the rotation of the driving body and displacement of an object being displaced by action from the driving body.

11 Claims, 10 Drawing Sheets

CONTROL APPARATUS

CROSS REFERENCE TO RELATED APPLICATION

The present application claims priority from Japanese Patent Application No. 2014-072519, filed on Mar. 31, 2014, the disclosure of which is incorporated herein by reference in its entirety.

BACKGROUND

1. Field of the Invention

The present teaching relates to a control apparatus.

2. Description of the Related Art

There is conventionally known a conveyance system which conveys a sheet by rotation of rollers. Further, there is known a system which detects the origin of rotation phase θ of the roller in order to achieve high-accuracy sheet conveyance. For example, in a case that the roller has eccentricity, the conveyance amount of the sheet varies depending on the rotation phase θ ($0 \leq \theta < 2\pi$) at the time of conveyance. Therefore, the high-accuracy sheet conveyance is achieved by detecting the origin of the rotation phase θ and controlling rotation of the roller while taking the rotation phase θ into account.

SUMMARY

According to an aspect of the present teaching, there is provided a control apparatus including: a motor; a driving body configured to rotate around a rotational axis by the motor; a rotary encoder including a disk and a sensor, the disk being fixed to the driving body in a state of being eccentric to the rotational axis of the driving body; and being configured to rotate with the driving body, and the sensor being configured to read a scale of the disk and to output a pulse signal depending on rotation of the disk; a detector configured to detect a rotation position and a rotation velocity of the disk based on the pulse signal outputted from the sensor; and a controller, wherein the controller is configured to perform: a data generation process of controlling the motor to make the driving body turn at least one rotation and generating velocity data based on the rotation position and the rotation velocity which are detected by the detector during the at least one rotation of the driving body, the velocity data indicating a locus of the rotation velocity with respect to the rotation position; a phase specifying process of specifying a position-phase relation, which is a correspondence relation between the rotation position of the disk and a rotation phase of the driving body, by detecting a phase, of a periodic velocity component of the locus indicated by the velocity data, with respect to the rotation position, the periodic velocity component corresponding to a rotation period of the driving body; and a main control process of controlling at least one of the rotation of the driving body and displacement of an object, which is displaced by action from the driving body, by driving the motor based on the position-phase relation specified by the phase specifying process.

BRIEF DESCRIPTION OF THE DRAWINGS

FIG. 7A depicts a sinusoidal wave before the search and FIG. 7B depicts a sinusoidal wave having a phase which matches the searched velocity locus.

DESCRIPTION OF THE EMBODIMENTS

Figure 1:
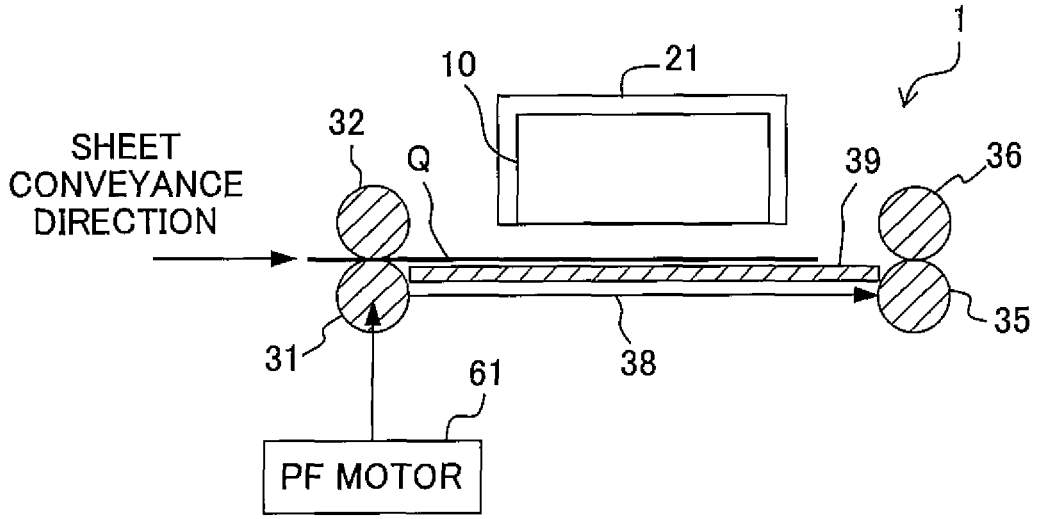
FIG. 1 is a schematic cross sectional view of the periphery of a sheet conveyance mechanism of an image forming system.

Hereinbelow, an embodiment of the present teaching will be explained with reference to the drawings. An image forming system 1 of this embodiment depicted in FIG. 1 is an ink-jet printer including a platen 39 on which a sheet Q passes and an ink jet head 10.

The ink-jet head 10 is disposed above the platen 39 in a state of being carried on a carriage 21. The ink-jet head 10 moves together with the carriage 21 in a main scanning direction (a direction orthogonal to the sheet surface of FIG. 1) orthogonal to a sheet conveyance direction. The ink jet head 10 discharges ink droplets while moving in the main scanning direction to form an image in the main scanning direction on the sheet Q.

That is, the image forming system 1 conveys the sheet Q to a first image formation position, and then moves the carriage 21 at a constant velocity in the main scanning direction. In this situation, ink droplets are discharged by the ink jet head 10 carried on the carriage 21 to form the image in the main scanning direction. After that, the image forming system 1 conveys the sheet Q downstream in the sheet conveyance direction so that the sheet Q arrives at a second image formation position. The image forming system 1 forms the image over the entire sheet Q by performing the above operations repeatedly.

The sheet Q is conveyed from the upstream side to the downstream side of the platen 39 upon receiving the force which is generated by rotations of a conveyance roller 31 and a discharge roller 35. The sheet conveyance direction is orthogonal to rotational axes of the conveyance roller 31 and the discharge roller 35. The conveyance roller 31 is disposed to face a driven roller 32 at the upstream side of the platen 39. The discharger roller 35 is disposed to face a driven roller 36 at the downstream side of the platen 39.

The conveyance roller 31 rotates while nipping or holding the sheet Q between itself and the driven roller 32 to convey the sheet Q downstream. The conveyance roller 31 is rotationally driven by a PF motor 61 constructed of a direct-current motor. The discharge roller 35 rotates while nipping or holding the sheet Q between itself and the driven roller 36 to convey the sheet Q, which is conveyed along the platen 39 by the conveyance roller 31, further downstream in the sheet conveyance direction.

The discharge roller 35 is connected to the conveyance roller 31 via a connection mechanism 38 (for example, a gear mechanism). The discharge roller 35 receives the power from the PF motor 61 via the conveyance roller 31 and the connection mechanism 38 to rotate in synchronization with the conveyance roller 31. The conveyance roller 31, the driven roller 32, the discharge roller 35, the driven roller 36, the connection mechanism 38, and the platen 39 constitute a conveyance mechanism 30 of the sheet Q (see FIG. 2).

Figure 2:
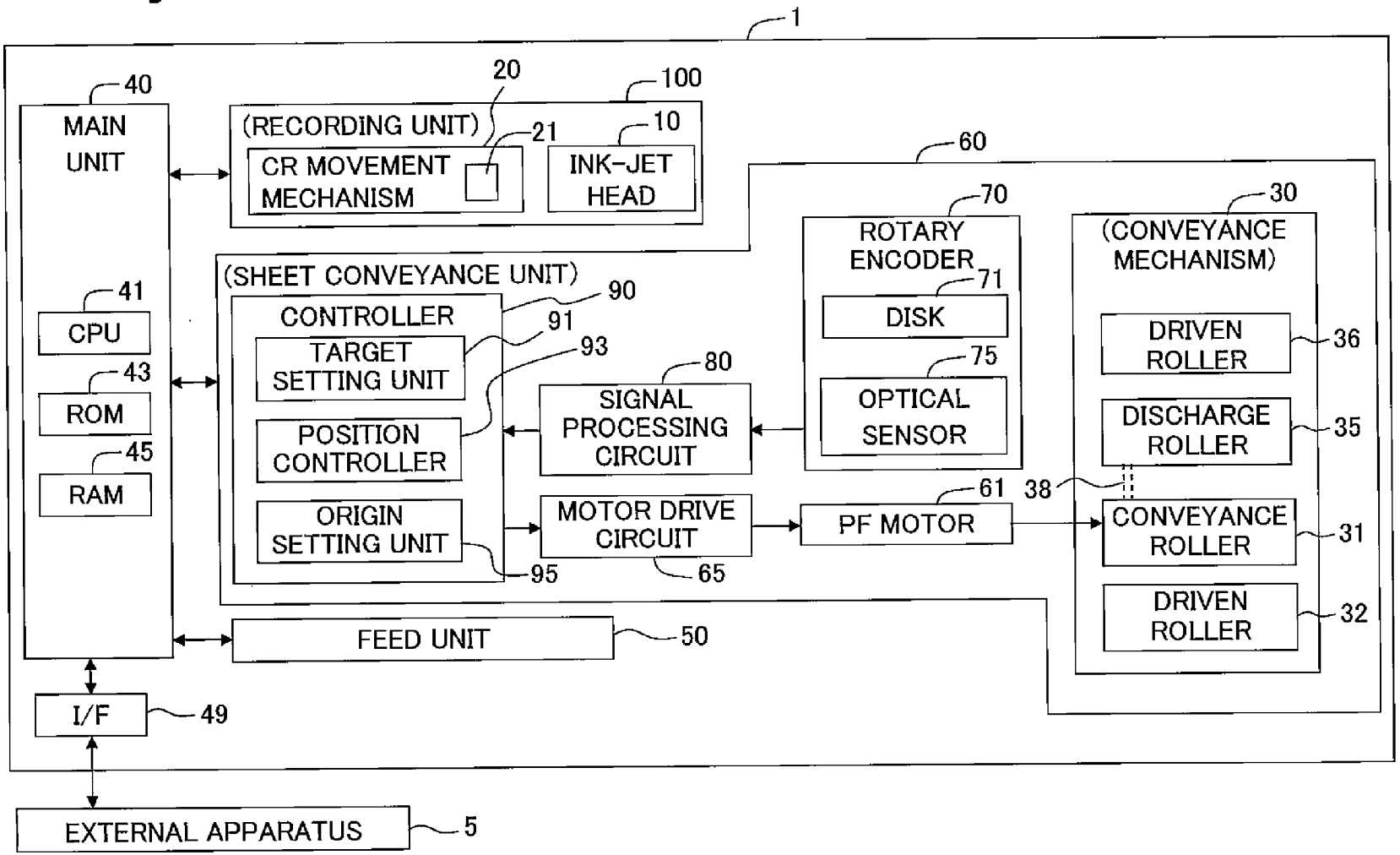
FIG. 2 is a block diagram depicting an electrical configuration of the image forming system.

Subsequently, the detailed construction of the image forming system 1 will be explained. As depicted in FIG. 2, the image forming system 1 is provided with a main unit 40, a communication interface 49, a feed unit 50, a sheet conveyance unit 60, and a recording unit 100.

The main unit 40 includes a CPU 41, a ROM 43, and a RAM 45 and controls the image forming system 1 in an integrated manner. The CPU 41 executes processes in accordance with programs stored in the ROM 43. The RAM 45 is used as a working memory when each of the processes is executed by the CPU 41.

In a case that the main unit 40 has received data to be printed from an external apparatus 5 via the communication interface 49, the main unit 40 inputs commands to the feed unit 50, the sheet conveyance unit 60, and the recording unit 100 to form the image based on the data to be printed on the sheet Q. The communication interface 49 is an interface such as a USB interface or a LAN interface which is capable of communicating with the external apparatus 5 such as a personal computer.

The feed unit 50 conveys the sheet Q from an unillustrated feed tray to a nip position of the sheet Q where the sheet Q is nipped between the conveyance roller 31 and the driven roller 32 in accordance with the command from the main unit 40. The sheet conveyance unit 60 intermittently conveys the sheet Q supplied from the feed unit 50 to each image formation position in accordance with the command from the main unit 40.

The recording unit 100 forms the image in the main scanning direction on the sheet Q at the timing at which the conveyance of the sheet Q by the sheet conveyance unit 60 is stopped. The recording unit 100 includes the ink-jet head 10, the carriage 21, and a carriage movement mechanism 20 which is capable of moving or reciprocating the carriage 21 in the main scanning direction.

Upon receipt of the command from the main unit 40 by the recording unit 100, the recording unit 100 causes the ink-jet head 10 to discharge ink droplets based on the data to be printed while moving the carriage 21 in the main scanning direction at the timing at which the conveyance of the sheet Q is stopped. Accordingly, the recording unit 100 forms the image in the main scanning direction on the sheet Q.

Upon receipt of the data to be printed by the main unit 40, the main unit 40 causes the feed unit 50 to supply the sheet Q to the nip position as described above. Next, the main unit 40 sets a target conveyance amount Yr of the sheet Q and causes the sheet conveyance unit 60 to convey the sheet Q to the first image formation position corresponding to the target conveyance amount Yr. After that, the main unit 40 controls the recording unit 100 to move the carriage 21 one way in the main scanning direction and to form the image corresponding to the one-way movement onto the sheet Q.

Then, the main unit 40 controls the sheet conveyance unit 60 to convey the sheet Q to the second image formation position corresponding to the target conveyance amount Yr. After that, the main unit 40 controls the recording unit 100 to move the carriage 21 one way in the main scanning direction and to form the image corresponding to the one-way movement onto the sheet Q. The main unit 40 causes the sheet conveyance unit 60 and the recording unit 100 to perform the above processes alternately so as to form the image based on the data to be printed on the sheet Q.

Subsequently, a detailed structure of the sheet conveyance unit 60 will be explained. As depicted in FIG. 2, the sheet conveyance unit 60 includes the conveyance mechanism 30, the PF motor 61, a motor drive circuit 65, a rotary encoder 70, a signal processing circuit 80, and a controller 90.

As described above, the conveyance mechanism 30 includes the conveyance roller 31, the driven roller 32, the discharge roller 35, the driven roller 36, the connection mechanism 38, and the platen 39 (not depicted in FIG. 2). The conveyance roller 31 and the discharge roller 35 are connected via the connection mechanism 38 to rotate in synchronization with each other. The conveyance mechanism 30 conveys the sheet Q in the sheet conveyance direction by rotating the conveyance roller 31 and the discharge roller 35 upon receipt of the power from the PF motor 61. The conveyance roller 31 is connected to the PF motor 61 via the gear.

The PF motor 61 is driven by the motor drive circuit 65 to rotate the conveyance roller 31. The motor drive circuit 65 drives the PF motor 61 by applying a drive current (or a drive voltage), which corresponds to an operation amount U inputted from the controller 90, to the PF motor 61.

Figure 3:
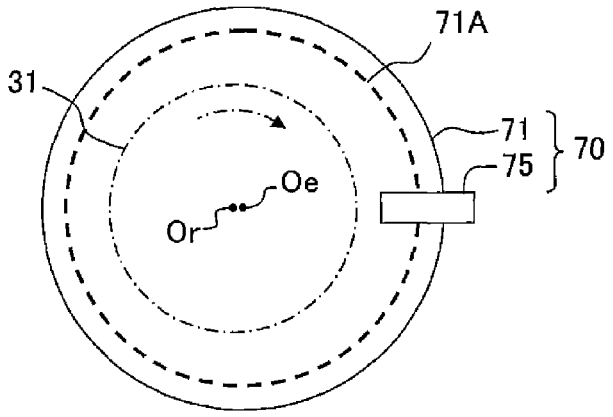
FIG. 3 depicts an arrangement of a disk and an optical sensor provided for a rotary encoder.

The rotary encoder 70 is provided to observe rotation of the conveyance roller 31. Like well-known rotary encoders, the rotary encoder 70 includes a disk 71 formed with a scale 71A and an optical sensor 75 reading the scale 71A. As depicted in FIG. 3, the disk 71 is fixed to the conveyance roller 31.

The scale 71A is formed as a plurality of slits which are aligned to be concentric with the disk 71 inside the circumference of the disk 71 at regular intervals. The disk 71 of this embodiment is fixed to an end of the conveyance roller 31 so that the center Oe of the disk 71 is disposed at a position deviated from a rotational axis Or of the conveyance roller 31. That is, the disk 71 is fixed to the end of the conveyance roller 31 in a state of being eccentric to the rotational axis Or of the conveyance roller 31.

The optical sensor 75 is arranged at an area, in the casing of the image forming system 1, over which the scale 71A passes. The optical sensor 75 outputs pulse signals every time each slit formed in the disk 71 passes over the optical sensor 75. The passage of each of the slits over the optical sensor 75 is caused by rotation of the disk 71 associated with rotation of the conveyance roller 31. That is, the optical sensor 75 outputs, as the pulse signals, an A-phase encoder signal and a B-phase encoder signal having a phase which is different from that of the A-phase encoder signal by $\pi/2$, every time each slit passes over the optical sensor 75.

The rotary encoder 70 of this embodiment is a well-known two-phase rotary encoder which is attached to the conveyance roller 31 in a state of being eccentric thereto. The rotary encoder 70 causes the optical sensor 75 to read the scale 71A formed in the disk 71 during rotation of the disk 71 and outputs the A-phase and B-phase encoder signals depending on the rotation of the disk 71.

The signal processing circuit 80 detects a rotation position X and a rotation velocity V of the disk 71 based on the A-phase and B-phase encoder signals from the rotary encoder 70 to input them to the controller 90. Specifically, in a case that the disk 71 rotates in a forward direction, the signal processing circuit 80 increments a count value X every time the pulse edge of each of the A-phase and B-phase encoder signals is detected. In a case that the disk 71 rotates in a reverse rotation, the signal processing circuit 80 decrements the count value X every time the pulse edge of each of the A-phase and B-phase encoder signals is detected. The signal processing circuit 80 inputs the count value X to the controller 90 as the rotation position X.

The signal processing circuit 80 measures the time interval between pulse edges of the A-phase encoder signal or the B-phase encoder signal. A value corresponding to a reciprocal of the time interval between pulse edges is inputted to the controller 90 as the rotation velocity V of the disk 71.

In addition to the above, the controller 90 includes a target setting unit 91, a position controller 93, and an origin setting unit 95. The target setting unit 91 sets a target stop position Xr, which corresponds to the target conveyance amount Yr designated by the main unit 40, in the position controller 93.

The position controller 93 inputs the operation amount U to the motor drive circuit 65, the operation amount U corresponding to a deviation E=Xr−X between the target stop position Xr set by the target setting unit 91 and the rotation position X obtained from the signal processing circuit 80. With this, the position controller 93 controls the PF motor 61 so that rotation of the conveyance roller 31 stops at a point at which the rotation position X is coincident with the target stop position Xr. That is, the position controller 93 controls the PF motor 61 so that the rotation position X detected by the signal processing circuit 80 is coincident with the target stop position Xr, thereby controlling the rotation of the conveyance roller 31 and the amount of conveyance of the sheet Q.

The origin setting unit 95 specifies a position-phase relation, which is a correspondence relation between the rotation position X of the disk 71 and the rotation phase θ of the conveyance roller 31, based on the rotation position X and the rotation velocity V those of which are obtained when the position controller 93 controls the PF motor 61 to rotate the conveyance roller 31 at a constant velocity. The origin setting unit 95 sets an origin position X0 based on the specified position-phase relation. Since the disk 71 is fixed to the conveyance roller 31, the rotation position X of the disk 71 can be also referred to as the rotation position X of the conveyance roller 31, and the rotation phase θ of the disk 71 can be also referred to as the rotation phase θ of the conveyance roller 31.

Specifically, the origin setting unit 95 generates velocity data which indicates a locus of the rotation velocity V with respect to the rotation position X obtained when the conveyance roller 31 rotates at a constant velocity. Then, the origin setting unit 95 specifies the position-phase relation based on variation of the locus indicated by the velocity data.

Figure 4:
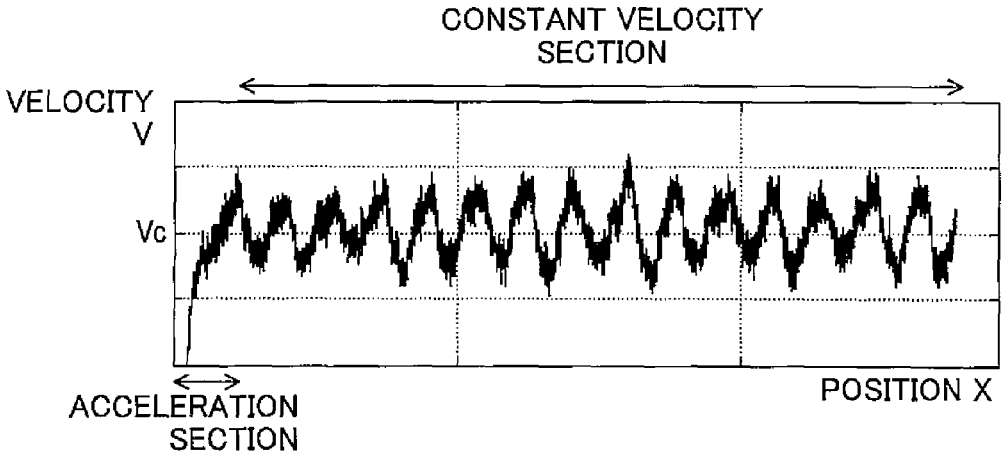
FIG. 4 is a graph indicating rotation positions and rotational velocities observed by the rotary encoder.

FIG. 4 is a graph indicating a relation between the rotation position X of the disk 71 and the rotation velocity V of the disk 71 during a period of time in which the conveyance roller 31 rotates at a constant velocity. The left end area of FIG. 4 is a locus of the velocity V during an acceleration section where the rotation velocity V has not yet reached a constant velocity Vc as the target velocity. As understood from FIG. 4, the rotation velocity V during a constant velocity section includes a velocity component which varies with respect to the rotation position X in accordance with a period corresponding to the rotation period of the conveyance roller 31 and the disk 71.

Figure 5:
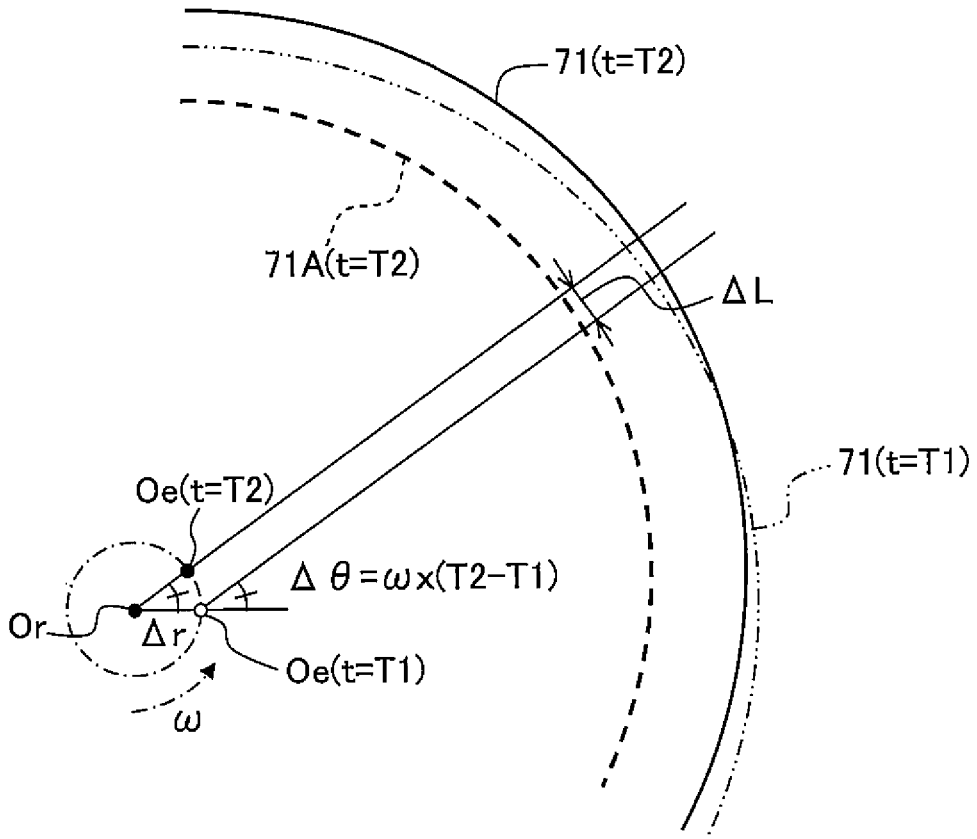
FIG. 5 depicts a displacement of a scale which is caused by a displacement of the center of the disk.

The reason why, even though the rotation velocity of the conveyance roller 31 is controlled to be constant, the rotation velocity V during the constant velocity section includes the varying velocity component is as follows. That is, the disk 71 is attached to the conveyance roller 31 in a state of being eccentric to the rotational axis of the conveyance roller 31. FIG. 5 depicts variation of the disk center Oe between a time T1 and a time T2 brought about when the conveyance roller 31 rotates at an angular velocity ω. In FIG. 5, the rotational axis Or of the conveyance roller 31 is away from the disk center Oe by a distance Δr. In this case, the disk center Oe is displaced, associated with rotation of the conveyance roller 31, to move along the arc of a radius Δr (along the one dot chain line of FIG. 5) of which center is the rotational axis Or of the conveyance roller 31.

The broken line depicted in FIG. 5 conceptually indicates the arrangement of the scale 71A (alignment of the slits) at the time T2, and the bold solid line depicted in FIG. 5 conceptually indicates the circumference of the disk 71 at the time T2. Meanwhile, the two dot chain lines depicted in FIG. 5 conceptually indicates the circumference of the disk 71 at the time T1. In FIG. 5, the distance Δr is depicted longer than the actual distance. In a case that the distance Δr is long, the variation of the disk 71 is large. This might cause such a problem that the optical sensor 75 cannot read the scale 71A. In order to prevent this problem, the distance Δr is set appropriately or suitably in this embodiment.

As depicted in FIG. 5, in a case that the conveyance roller 31 rotates between the time T1 and the time T2 by an angle Δθ=ω(T2−T1), the variation amount of the scale 71A brought about when the disk center Oe is coincident with the rotational axis Or is different from the variation amount of the scale 71A brought about when the disk center Oe is not coincident with the rotational axis Or by a distance ΔL.

The variation of the rotation velocity V depicted in FIG. 4 is brought about by the distance ΔL. This variation is geometrically defined according to positions of the rotational axis Or, the disk center Oe, and the optical sensor 75. For example, the variation is caused by displacement of the disk center Oe parallelly to and perpendicularly to a displacement direction of each slit passing over the optical sensor 75. Thus, obtaining the correspondence relation between the phase θ of the varying velocity component and the rotation position X results in obtaining the correspondence relation between the rotation phase θ and the rotation position X of the conveyance roller 31. In this embodiment, the position-phase relation is specified by use of this principle.

Specifically, the origin setting unit 95 searches a sinusoidal wave, which matches the locus of the rotation velocity V observed by the rotary encoder 70, while changing an initial phase of a sinusoidal wave having a period which is coincident with the rotation period of the conveyance roller 31. Then, the origin setting unit 95 specifies the position-phase relation based on the relation between the rotation position X and the initial phase of the sinusoidal wave which matches the locus.

Figure 6A:
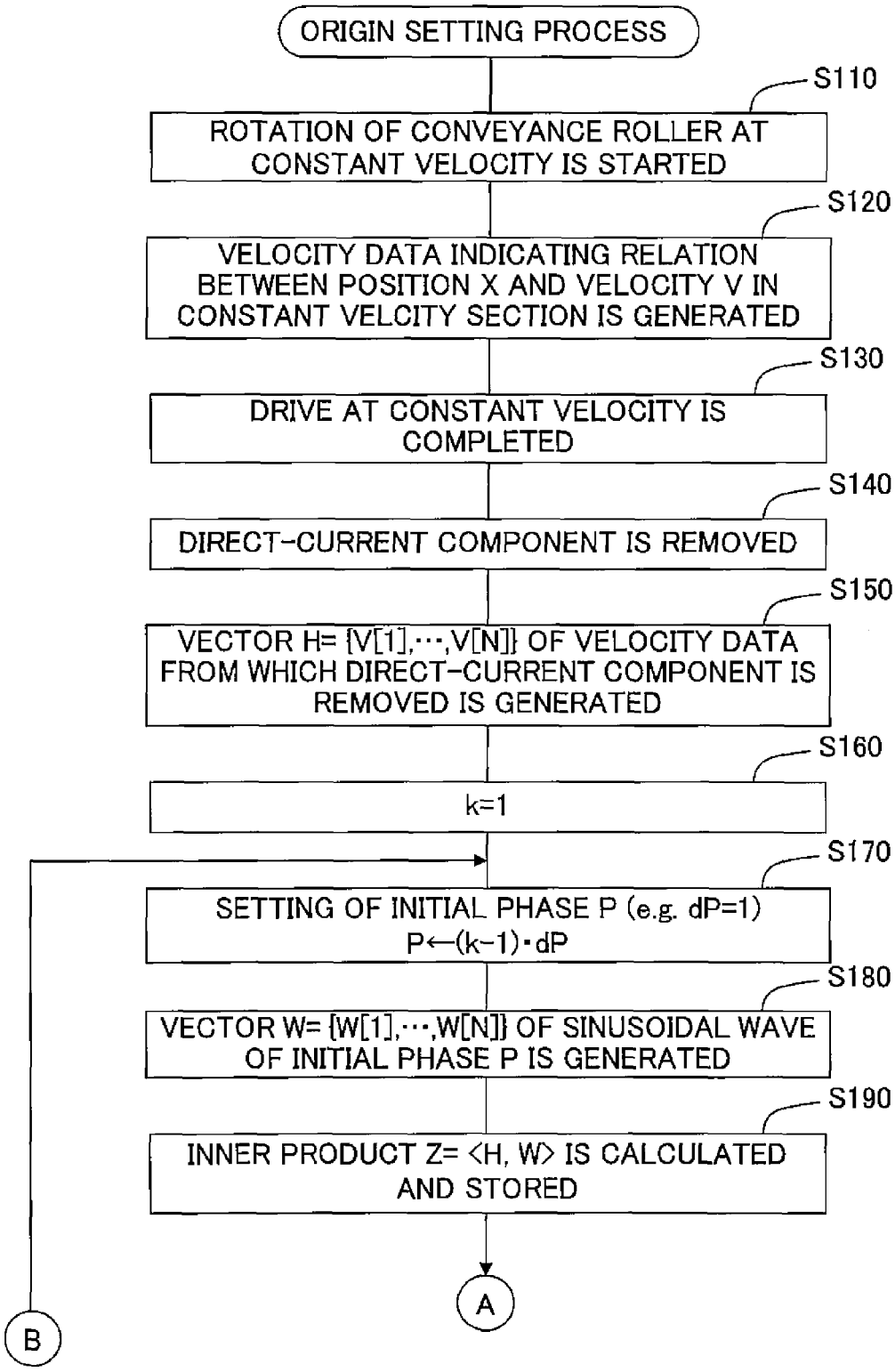
FIGS. 6A and 6B depict a flowchart indicating an origin setting process executed by an origin setting unit.
Figure 6B:
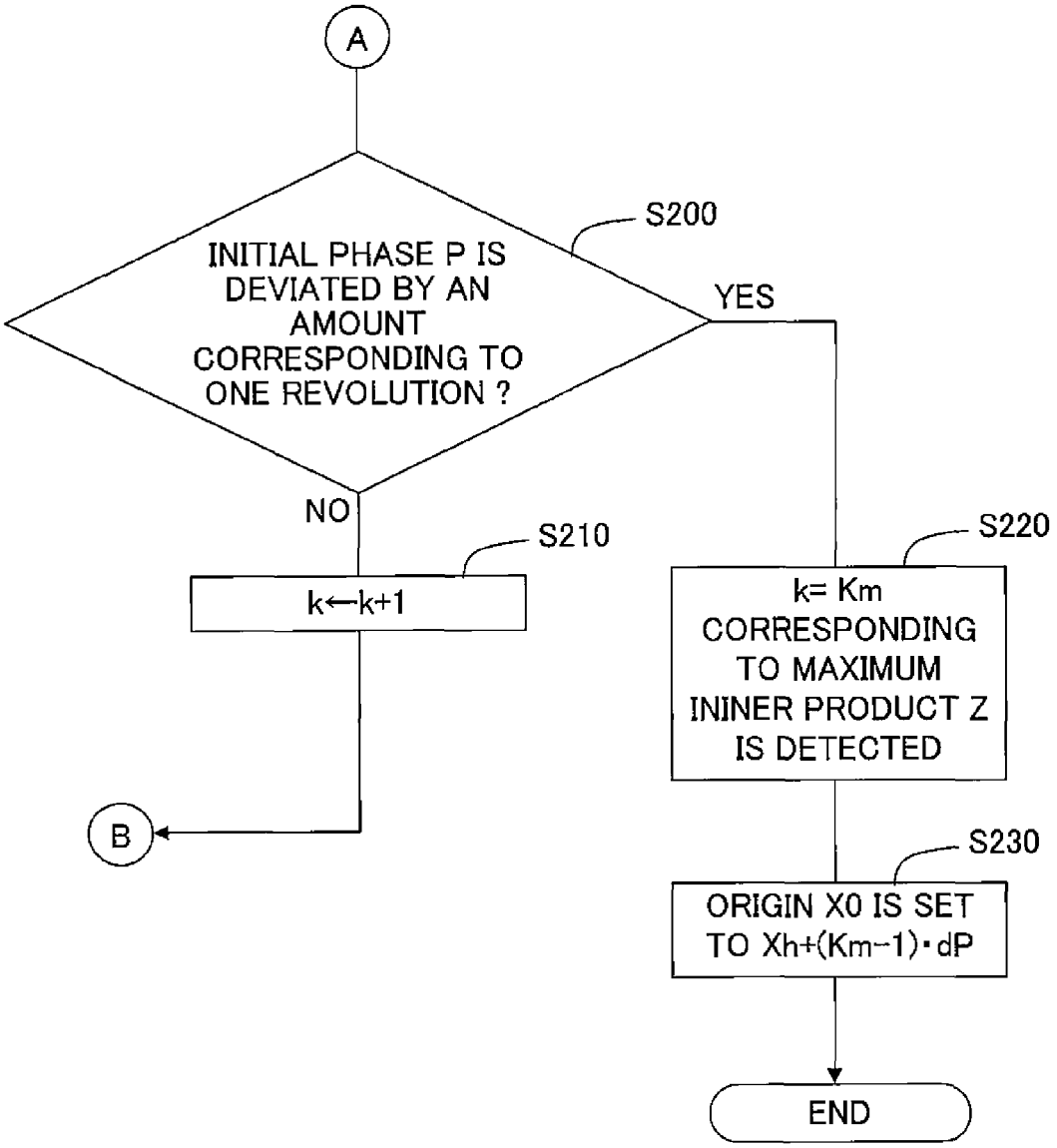

Here, an origin setting process, which is executed by the origin setting unit 95 according to the command from the main unit 40, will be explained by use of FIGS. 6A and 6B. The main unit 40 inputs an origin setting command to the controller 90 when the image forming system 1 is switched on. The origin setting unit 95 starts the origin setting process in accordance with this command.

In a case that the origin setting process is started, the origin setting unit 95 starts the control of the PF motor 61 to rotate the conveyance roller 31 at a constant velocity (S110). Specifically, the origin setting unit 95 calculates the operation amount U for the PF motor 61 and inputs the calculated operation amount U to the motor drive circuit 65. Accordingly, the origin setting unit 95 controls the PF motor 61 to rotate the conveyance roller 31 at the constant velocity.

In this context, the PF motor 61 can be controlled to rotate the conveyance roller 31 at the constant velocity by performing a feedback control based on the rotation velocity V obtained from the signal processing circuit 80. In this case, however, the sensitivity of the feedback control is required to be low so that the feedback control never interferes with the variation of the rotation velocity V due to the eccentricity. Instead of the feedback control, the PF motor 61 can be controlled to rotate the conveyance roller 31 at the constant velocity by performing a feedforward control.

After the rotation of the conveyance roller 31 is started at S110, the origin setting unit 95 waits until the conveyance roller 31 rotates at the constant velocity. Then, the origin setting unit 95 stores, based on the rotation position X and the rotation velocity V inputted from the signal processing circuit 80, the rotation velocity V while being correlated with the rotation position X, every time the rotation position X increases, during the constant velocity section in which the conveyance roller 31 rotates at the constant velocity. Accordingly, the origin setting unit 95 generates velocity data indicating the relation between the rotation position X and the rotation velocity V during the constant velocity section (S120).

The origin setting unit 95 generates velocity data indicating the relation between the rotation position X and the rotation velocity V during a period in which the conveyance roller 31 turns at least one revolution at the constant velocity. In order to specify the position-phase relation with high accuracy, it is preferred that the velocity data be generated by storing the rotation position X and the rotation velocity V while being correlated with each other over a sufficient time longer than the rotation period of the conveyance roller 31.

In a case that the generation of velocity data in the constant velocity section is completed, the origin setting unit 95 completes the drive of the PF motor 61 started at S110 (S130). Then, the origin setting process proceeds to S140. At S140, the origin setting unit 95 removes a direct-current component from the locus of the rotation velocity V indicated by the generated velocity data. For example, in a case that the PF motor 61 is controlled to rotate the conveyance roller 31 at the constant rotation velocity V=Vc, the locus of the rotation velocity V indicated by the velocity data shows the waveform of which amplitude center is the constant rotation velocity V=Vc (see FIG. 4). At S140, the origin setting unit 95 removes the direct-current component from the locus of the rotation velocity V, and the origin setting unit 95 processes the velocity data so that the amplitude center of the locus of the rotation velocity V is zero.

Specifically, the origin setting unit 95 calculates an average value VA of the rotation velocity V indicated by the velocity data at S140. Then, the origin setting unit 95 removes the direct-current component from the locus of the rotation velocity V by subtracting the average value VA from the rotation velocity V at each rotation position X which is indicated by the velocity data.

After that, the origin setting unit 95 generates, based on the velocity data from which the direct-current component is removed, a vector H=(V[1], . . . , V[N]) of the velocity data (S150). The vector H includes, as elements, a plurality of rotational velocities V at a plurality of rotation positions X which are indicated by the velocity data from which the direct-current component is removed. The rotational velocities V are aligned in ascending order of the rotation position X. In this context, "N" means the number of samples of rotational velocities V included in the velocity data.

After S150, the origin setting unit 95 sets a variable k to 1 (S160), and the origin setting unit 95 sets an initial phase P of the sinusoidal wave according to the equation of P=(k−1)·dP (S170). The unit of the initial position P used herein is not radian but the same unit as the rotation position X. The constant dP corresponds to a deviation amount of the initial phase P and the constant dP can be determined, for example, to have a value 1. The constant dP, however, may be determined to have a value greater than 1. The value of the constant dP can be determined appropriately. The calculation amount is smaller as the value of the constant dP is greater. In order to specify the origin position X0 with high accuracy, it is preferred that dP be smaller.

Then, the origin setting unit 95 generates a vector W=(W[1], . . . , W[n]) which indicates the sinusoidal wave of the initial phase P (S180). An element W[n] of the vector W (n=1, . . . , N) is represented by the following equation.

$$W[n]=\sin\{2\pi\cdot\{(n-1)-P\}/Xc\}$$

In this equation, the value Xc is the increment of the rotation position X brought about when the disk 71 turns one revolution. That is, the value Xc indicates the variation amount of the rotation position X brought about when the disk 71 turns one revolution, in other words, brought about when the conveyance roller 31 turns one revolution. The value Xc is a fixed value and the value Xc can be stored in the origin setting unit 95 or the ROM 43 in advance. In a case that the initial phase P is 0, the vector W of the sinusoidal wave of which phase is 0 is generated at a rotation position Xh corresponding to the element V[1] of the vector H.

As another example, at S120, the origin setting unit 95 may generate velocity data while correlating the rotation position X with the rotation velocity V those of which are inputted from the signal processing circuit 80 every sampling period which is defined in advance to be longer than the time in which the rotation position X is increased by one. In this case, at S180, it is possible to generate, as the vector W of the sinusoidal wave, the vector W which includes, as the element, the value of the sinusoidal wave at each rotation position X corresponding to each element of the vector H.

After that, the origin setting unit 95 calculates an inner product Z=<H,W> of the vector H and the vector W, and the origin setting unit 95 stores the inner product Z while correlating the inner product Z with the value of the variable k (S190). Then, the origin setting unit 95 judges whether or not the initial phase P is deviated by an amount corresponding to one revolution (S200). Specifically, the origin setting unit 95 judges whether or not k≥(Xc/dP) is held. Here, in a case that the origin setting unit 95 judges that k<(Xc/dP) is held (S200: No), the origin setting unit 95 increments the variable k by one (S210). Then, the origin setting process returns to S170.

In a case that the process returns to S170, the origin setting unit 95 sets the initial phase P based on the variable k after the increment. At S180, the vector W of the sinusoidal wave is generated by deviating the most recent initial phase P by an amount corresponding to dP. At S190, the inner product Z of this vector W and the vector H based on the velocity data from which the direct-current component is removed is calculated and the inner product Z is stored while being correlated with the value of the variable k.

Figure 7A:
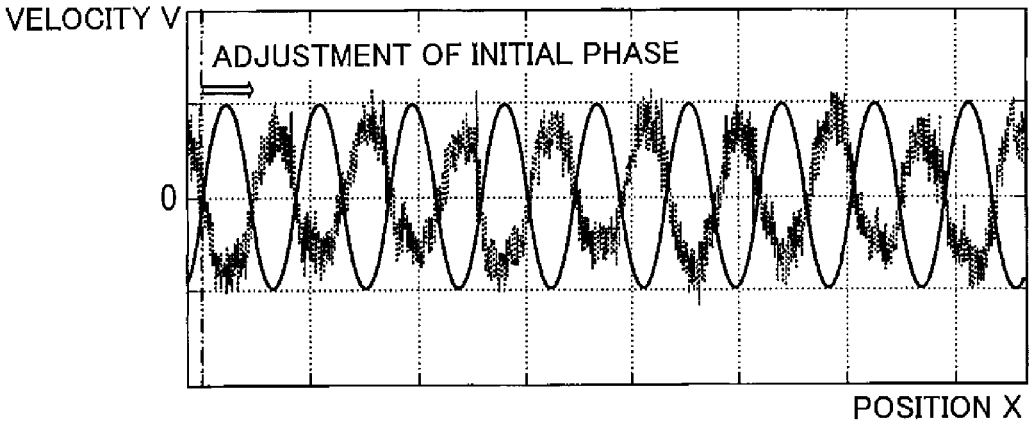
FIGS. 7A and 7B are illustrative views each illustrating a search aspect of a sinusoidal wave which matches a velocity locus.

By repeatedly performing the process ranging from S170 to S210, the origin setting unit 95 calculates the inner product Z of the sinusoidal wave and the locus indicated by the velocity data while deviating the initial phase P by the amount corresponding to dP as depicted in FIG. 7A. In a case that the origin setting unit 95 judges that the initial phase is deviated by the amount corresponding to one revolution (S200: Yes), the origin setting unit 95 performs the process of S220.

Figure 7B:
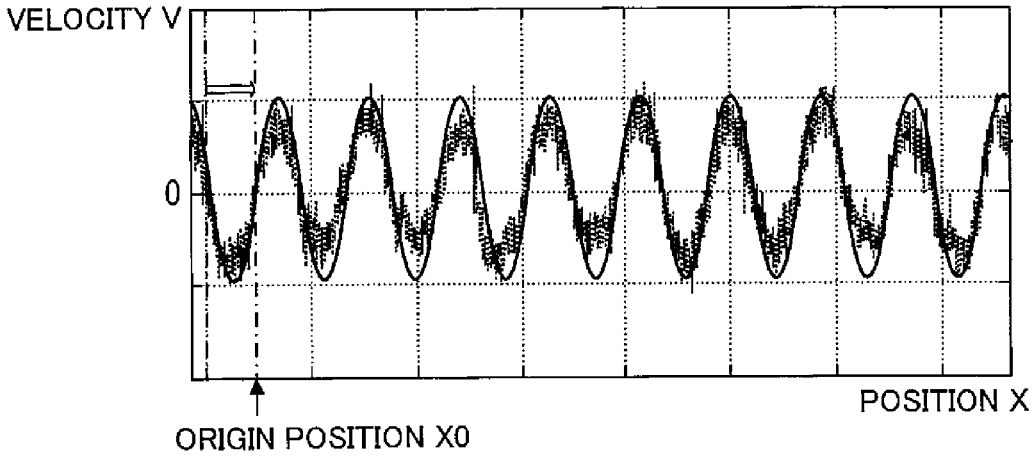

At S220, the origin setting unit 95 specifies the inner product Z having a maximum value from among the inner products Z corresponding to one revolution, and the origin setting unit 95 specifies a value k=Km of the variable k corresponding to the inner product Z having the maximum value (S220). The maximum value of the inner product Z is brought about when the phase of the sinusoidal wave matches the phase of variation component of the rotation velocity V as depicted in FIG. 7B. After that, the origin setting unit 95 sets, as the origin position X0 of the rotation position X, a value which is obtained by being deviated from the rotation position Xh corresponding to the element V[1] of the vector H by an amount of {(Km−1)·dP} (S230). That is, Xh+{(Km−1)·dP} is set as the origin position X0 (S230). This origin position X0 corresponds to a point at which the phase of the sinusoidal wave, which makes the value of inner product Z maximum, is zero. After that, the origin setting unit 95 completes the origin setting process.

Figure 8A:
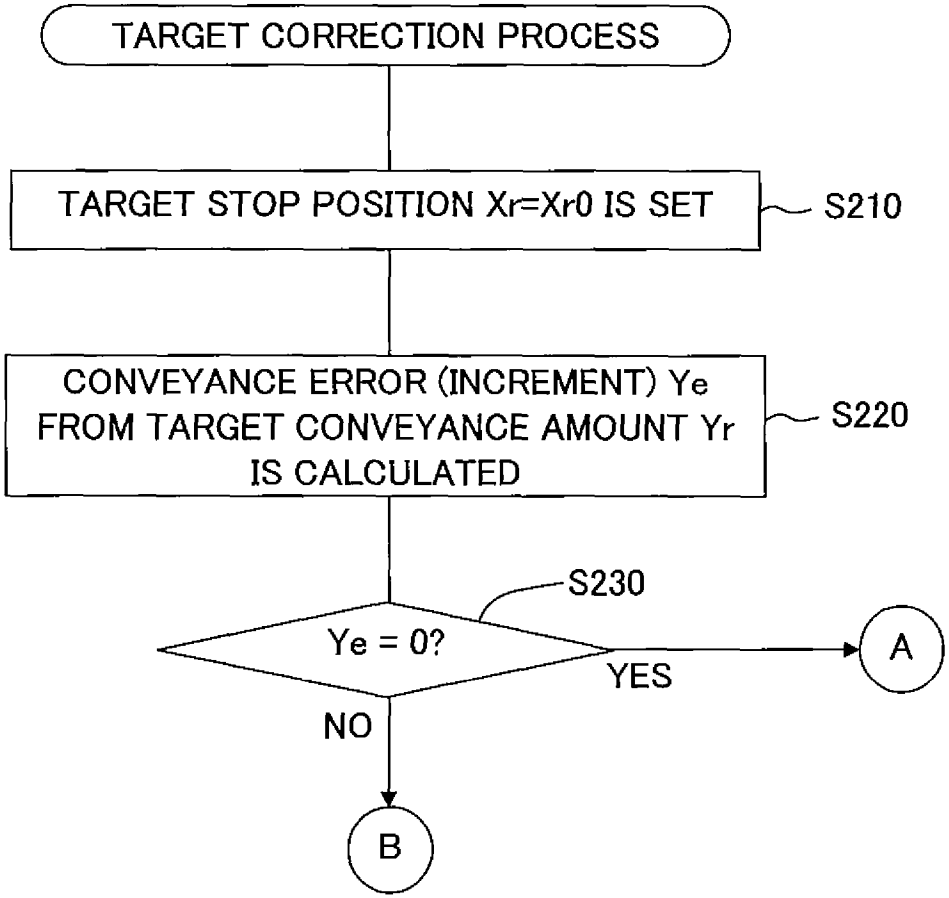
FIGS. 8A and 8B depict a flowchart indicating a target correction process executed by a target setting unit.
Figure 8B:
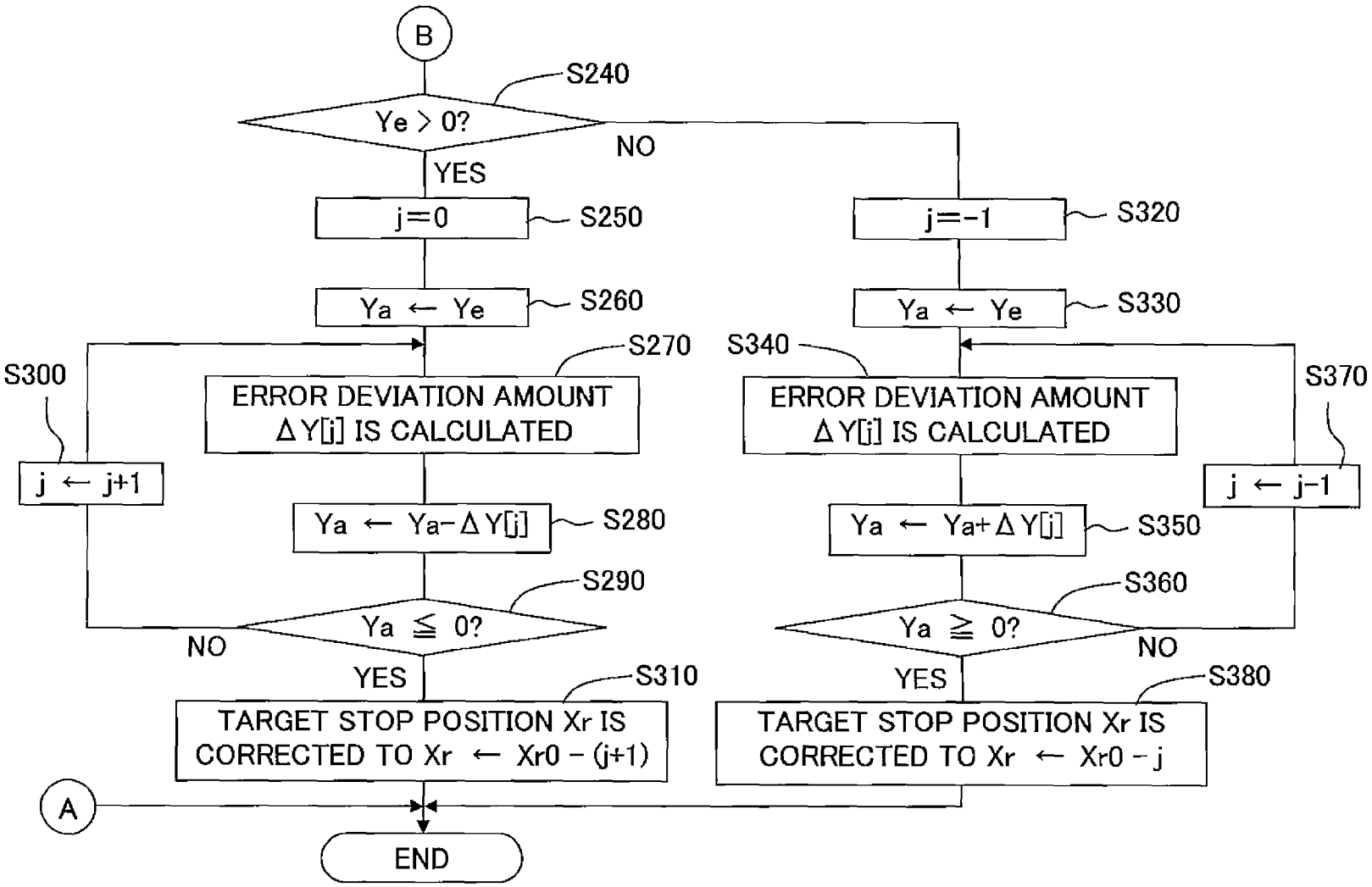

Subsequently, an explanation will be made about a target correction process executed by the target setting unit 91 with reference to FIGS. 8A, 8B and FIG. 9. The target correction process indicated in FIGS. 8A and 8B includes steps for correcting the target stop position Xr of the conveyance roller 31 which corresponds to the target conveyance amount Yr of the sheet Q designated by the main unit 40 (i.e., the target stop position Xr=Xr0 in which the eccentricity of the disk 71 is not taken into consideration).

Upon receipt the target conveyance amount Yr and the conveyance command of the sheet Q from the main unit 40, the target setting unit 91 executes the target correction process. Specifically, the target setting unit 91 corrects the target stop position Xr corresponding to the target conveyance amount Yr from the target stop position Xr=Xr0 in which the eccentricity of the disk 71 is not taken into consideration. The position controller 93 controls the PF motor 61 based on the target stop position Xr corrected by the target setting unit 91. Accordingly, the conveyance roller 31 is rotated to reach the target stop position Xr, thereby conveying the sheet Q by the target conveyance amount Yr.

In a case that the disk 71 is attached to the conveyance roller 31 such that the disk center Oe is coincident with the rotational axis Or of the conveyance roller 31 like conventional apparatuses, a sheet conveyance amount dY, brought about when the rotation position X of the disk 71 is increased by one, ideally stays constant. Thus, in order to convey the sheet Q by the target conveyance amount Yr, the target stop position Xr may be set to Xs+(Yr/dY) based on a conveyance start position X=Xs. In this context, Xs indicates the rotation position X at the time of starting the conveyance of the sheet Q. Accordingly, the sheet Q can be conveyed by the target conveyance amount Yr.

In this embodiment, however, the disk 71 is attached to the rotational axis Or of the conveyance roller 31 in a state of being eccentric thereto. In this case, a sheet conveyance amount dY(θ) brought about when the rotation position X of the disk 71 is increased by one varies according to the rotation phase θ of the disk 71. FIG. 9 is a graph indicating a conveyance deviation amount δ(θ) of the sheet Q when the disk center Oe is attached to the conveyance roller 31 in a state of being eccentric thereto.

Figure 9:
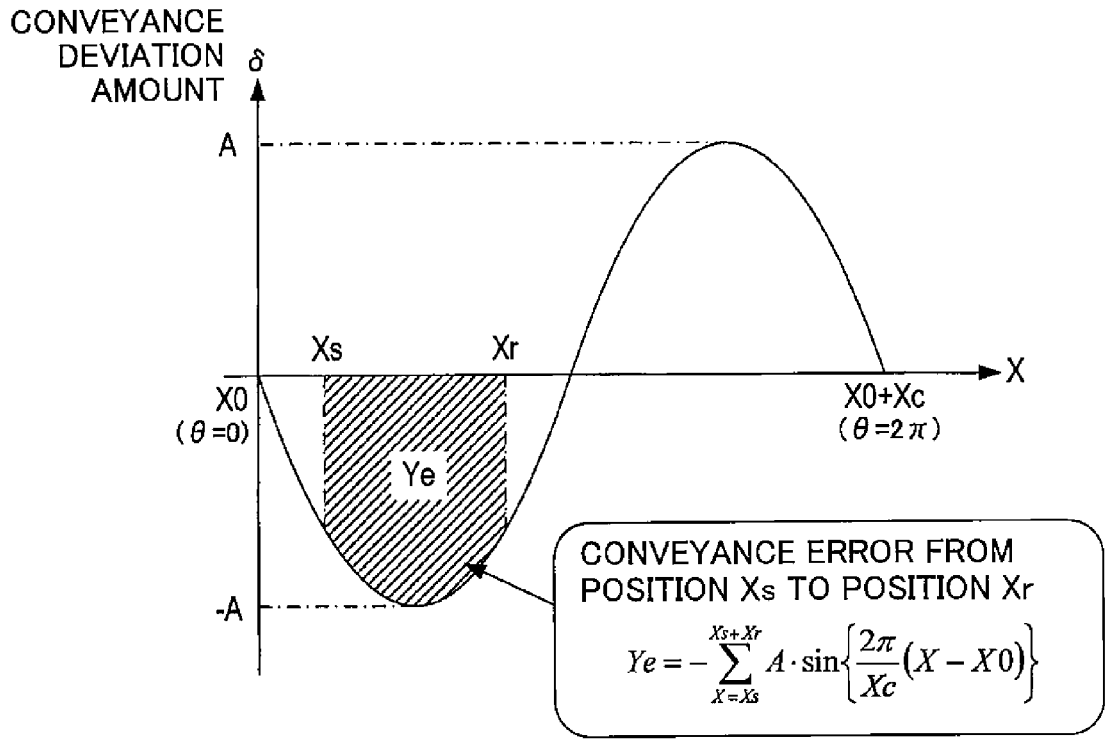
FIG. 9 is an illustrative view illustrating an amount of deviation of conveyance.

In FIG. 9, the horizontal axis represents the rotation position X. The relation between the rotation phase θ ($0 \le \theta < 2\pi$) and the rotation position X can be represented by the equation of $\theta = 2\pi \cdot (X - X0)/Xc$ using the origin position X0. In a case that the disk 71 has the eccentricity, the sheet conveyance amount dY(θ) brought about when the disk 71 is rotated from the rotation phase θ to increase the rotation position X by one can be represented by the equation of dY(θ)=dY+δ(θ). That is, the conveyance deviation amount δ(θ) indicated in FIG. 9 represents a value {dY(θ)−dY} obtained by subtracting the sheet conveyance amount dY brought about when the disk 71 has no eccentricity from the sheet conveyance amount dY(θ) brought about when the disk 71 has the eccentricity.

As described above, the origin position X0 corresponds to the rotation position X of when the variation component of the rotation velocity V crosses the amplitude center in the forward direction. That is, in a case that the rotation phase θ ranges from 0 to π, a rotation velocity V to be measured is indicated to be greater than an actual velocity due to the eccentricity. This means that an apparent sheet conveyance amount calculated from the rotation position X is greater than an actual sheet conveyance amount in the case that the rotation phase θ ranges from 0 to π. Therefore, the conveyance deviation amount δ(θ) indicated in FIG. 9 adopts a negative value in the case that the rotation phase θ ranges from 0 to π.

As indicated in FIG. 9, the conveyance deviation amount δ(θ) of the sheet Q brought about when the rotation phase θ is increased by (2π/Xc) corresponding to one unit of the rotation position X is represented by the equation of $\delta(\theta) = -A \cdot \sin(\theta)$. The amplitude A (>0) represents the apparent conveyance amount of the sheet Q which corresponds to the amount of variation of the rotation position X of when the disk center Oe is displaced in the displacement direction of the slit passing the optical sensor 75. The amplitude A can be obtained by desk calculation or actual measurement, and can be stored in the target setting unit 91 or the ROM 43 in advance.

In a case that the relation between the conveyance deviation amount δ(θ) and the rotation phase θ is held as described above, a conveyance error Ye of the sheet Q from the conveyance start position X=Xs of the sheet Q to the target stop position Xr of the sheet Q corresponds to the hatched area depicted in FIG. 9, and the conveyance error Ye can be represented by the following expression.

$$Ye = -\sum_{X=Xs}^{Xs+Xr} A \cdot \sin\left\{\frac{2\pi}{Xc}(X - X0)\right\} \tag{1}$$

The conveyance error Ye indicates a conveyance amount, which is increased from the sheet conveyance amount Y=dY·(Xr−Xs) within the range from the rotation position X=Xs to the target position Xr in a case that the eccentricity is not taken into consideration. In the target correction process depicted in FIGS. 8A and 8B, the target stop position Xr which corresponds to the target conveyance amount Yr designated by the main unit 40 is set to the target stop position Xr=Xr0=Xs+Yr/dY which is supposed to have no eccentricity. The target stop position Xr=Xr0 is corrected by an amount corresponding to the conveyance error Ye to calculate the target stop position Xr for conveying the sheet Q by the target conveyance amount Yr.

Specifically, in a case that the target correction process is started, the target setting unit 91 sets the target stop position Xr which corresponds to the target conveyance amount Yr designated by the main unit 40 to the target stop position Xr=Xr0=Xs+Yr/dY in which the eccentricity of the disk 71 is not taken into consideration (S210). After that, the target setting unit 91 sets the target stop position Xr to Xr0 in accordance with the expression (1), and calculates the conveyance error (increment) Ye, of the sheet conveyance amount Y, from the target conveyance amount Yr at the time of driving the PF motor 61 (S220).

Next, the target setting unit 91 judges whether or not the calculated conveyance error Ye is zero (S230). In a case that the target setting unit 91 judges that the calculated conveyance error Ye is zero (S230: Yes), the target setting unit 91 completes the target correction process without any correction for the target stop position Xr.

In a case that the target setting unit 91 judges that the conveyance error Ye is not zero (S230: No), the target setting unit 91 judges whether or not the conveyance error Ye is a positive or plus (S240). In a case that the target setting unit 91 judges that the conveyance error Ye is the positive (S240: Yes), the target setting unit 91 performs the process of S250.

At S250, the target setting unit 91 sets a variable j to zero. Further, the target setting unit 91 sets the conveyance error Ye calculated at S220 as a conveyance error Ya (S260). After that, the target setting unit 91 executes processes subsequent to S270.

At S270, the target setting unit 91 calculates an error variation amount ΔY[j] in accordance with the following expression. The error variation amount ΔY[j] is a variation amount of the conveyance error Ya obtained by reducing the target stop position Xr from (Xr0−j) to (Xr0−(j+1)). As described above, dY is a sheet conveyance amount brought about when the rotation position X is increased by one in a state that the disk 71 has no eccentricity.

$$\Delta Y[j]=dY-A\cdot\sin\{2\pi\cdot(Xr0-j-X0)/Xc\}$$

After that, the target setting unit 91 updates the conveyance error Ya to a value obtained by subtracting the value ΔY[j] from the current conveyance error Ya (Ya←Ya−ΔY[j]).

The target setting unit 91 judges whether or not the updated conveyance error Ya is zero or less (S290). In a case that the target setting unit 91 judges that the updated conveyance error Ya is more than zero (S290: No), the target setting unit 91 updates the valuable j to a value to which one is added, and executes the process of S270 (S300). Accordingly, the conveyance error Ya from the target conveyance amount Yr which is obtained by reducing the target stop position Xr to make the conveyance error Ya zero or less, is calculated in steps.

In a case that the target setting unit 91 judges that the conveyance error Ya is zero or less (S290: Yes), the target setting unit 91 corrects the target stop position Xr to Xr={Xr0−(j+1)} (S310) and completes the target correction process.

Meanwhile, in a case that the target setting unit 91 judges at S240 that the conveyance error Ye is a minus or negative (S240: No), the target setting unit 91 sets the variable j to −1 (S320). Further, the target setting unit 91 sets the conveyance error Ye calculated at S220 as the conveyance error Ya (S330). After that, the target setting unit 91 executes processes subsequent to S340.

At S340, the target setting unit 91 calculates an error change amount ΔY[j] in accordance with the following expression. The error variation amount ΔY[j] is a variation amount of the conveyance error Ya which is obtained by increasing the target stop position Xr from (Xr0−(j+1)) to (Xr0−j).

$$\Delta Y[j]=dY-A\cdot\sin\{2\pi\cdot(Xr0-j-X0)/Xc\}$$

After that, the target setting unit 91 updates the conveyance error Ya to a value obtained by adding the value ΔY[j] to the current conveyance error Ya (Ya←Ya+ΔY[j]) (S350).

The target setting unit 91 judges whether or not the updated conveyance error Ya is zero or more (S360). In a case that the target setting unit 91 judges that the updated conveyance error Ya is less than zero (S360: No), the target setting unit 91 updates the valuable j to a value from which one is subtracted, and executes the process of S340 (S370). Accordingly, the conveyance error Ya from the target conveyance amount Yr which is obtained by increasing the target stop position Xr to make the conveyance error Ya zero or more, is calculated in steps.

In a case that the target setting unit 91 judges that the conveyance error Ya is zero or more (S360: Yes), the target setting unit 91 corrects the target stop position Xr to Xr=(Xr0−j) (S380), and completes the target correction process.

After completion of the target correction process, the target setting unit 91 further corrects the target stop position Xr which has been corrected in the target correction process while taking into consideration the conveyance error of the sheet Q caused by a factor other than the eccentricity of the disk 71 to the conveyance roller 31. Then, the target setting unit 91 sets the corrected target stop position Xr in the position controller 93.

For example, the target setting unit 91 further corrects the target correction position Xr by using a known technology to clear the conveyance error caused by the deviation of the rotational axis Or of the conveyance roller 31 from the center. Then, the target setting unit 91 may set the target stop position Xr after this correction in the position controller 93. This correction needs information of the rotation phase θ of the conveyance roller 31. As the information of the rotation phase θ of the conveyance roller 31, it is possible to use the correspondence relation between the rotation phase θ and the rotation position X of the disk 71 specified by the origin setting unit 95.

It is noted that the conveyance error caused by the deviation of the rotational axis Or of the conveyance roller 31 from the center can be substantially cleared or removed by adjusting the amplitude A of the expression (1) and the initial phase in the sine function of the expression (1) those of which are used in the target correction process, without any further correction for the target stop position Xr which has been corrected in the target correction process. This is because the vibration component caused by this deviation has the same frequency as that of the vibration component caused by the eccentricity of the disk 71.

Therefore, the target setting unit 91 can achieve the conveyance of the sheet Q with high accuracy by setting the target stop position Xr, which has been corrected in the target correct process, in the position controller 93 to prevent the conveyance error caused by the eccentricity of the conveyance roller 31 without any further correction. The adjustment of the amplitude A and the initial phase for which the eccentricity of the conveyance roller 31 is taken into consideration can be performed based on, for example, the result of test printing.

In the above description, the image forming system 1 according to this embodiment has been explained. In this embodiment, the disk 71 of the rotary encoder 70 is provided in a state of being eccentric to the rotational axis Or of the conveyance roller 31 purposefully. This causes the variation corresponding to the rotation period of the disk 71 in the locus of the rotation velocity V with respect to the rotation position X. The phase θ of the variation component corresponds to the rotation phase θ of the disk 71 and the rotation phase θ of the conveyance roller 31. In this embodiment, the relation between the phase θ of the variation component and the rotation position X is obtained to define the rotation position X of when the phase θ of the variation component is zero as the origin position X0. That is, the position-phase relation between the rotation position X and the rotation phases θ of the conveyance roller 31 and the disk 71 is specified to $\theta-2\pi\sim(X-X0)/Xc$, and subsequent motor control (conveyance control of the sheet Q) is performed based on this relation.

According to this embodiment, unlike conventional encoder disks, it is not necessary to provide any dedicated sensor or structure for detecting the origin. Thus, it is possible to reduce the number of components and production costs. Further, since it is possible to specify the position-phase relation and to set the origin with high accuracy, it is possible to control at least one of the rotation of the conveyance roller 31 and the displacement (conveyance) of the sheet Q which is displaced by the action or effect from the conveyance roller 31 with high accuracy.

In this embodiment, the velocity data is generated while the conveyance roller 31 is rotated at a constant velocity. Then, the process for removing the direct-current component from the velocity data is performed. That is, the component, which is not required for specifying the position-phase relation, is removed from the velocity data. Therefore, it is possible to specify the position-phase relation and to set the origin position with higher accuracy.

In this embodiment, the position-phase relation is specified as follows. That is, the phase θ, of the sinusoidal wave having the same period as the rotation period of the conveyance roller 31 and matching the velocity locus indicated by the velocity data, with respect to the rotation position X is detected. The sinusoidal wave matching the velocity locus is a sinusoidal wave having the same period as the rotation period of the conveyance roller 31 and having the maximum value of the inner product of the sinusoidal wave and the velocity locus from which the direct-current component is removed. The position-phase relation is specified based on the initial phase P of such a sinusoidal wave. Therefore, according to this embodiment, it is possible to specify the position-phase relation and to set the origin position with high accuracy by performing the simple calculation process concerning the velocity data such as the calculation of the inner product and the detection of the maximum value.

According to this embodiment, the target stop position Xr is corrected to make the conveyance error Ye zero based on the corresponding relation between the rotation phase θ and the sheet conveyance amount $\Delta Y=dY-A\cdot\sin\theta$ brought about when the conveyance roller 31 is varied from the rotational phase θ by an amount corresponding to one unit of the rotation position X. Therefore, according to this embodiment, the target stop position Xr corresponding to the target conveyance amount Yr can be set easily and appropriately to control the conveyance amount of the sheet Q with high accuracy.

In the above description, the explanation has been made about the embodiment of the present teaching. The present teaching, however, is not limited to the embodiment and the present teaching can adopt various aspects. For example, the processes achieved by the controller 90 may be achieved with hardware or software.

In the above embodiment, the point at which the phase of the sinusoidal wave matching the variation component of the rotation velocity V is zero is set as the origin position X0. However, a point at which the phase of the sinusoidal wave is other than zero may be set as the origin position X0. For example, a point at which the phase of the sinusoidal wave is π may be set as the origin position X0 or a point which is convenient for the calculation of the conveyance error Ye may be set as the origin position X0.

In the above embodiment, the sinusoidal wave matching the velocity locus indicated by the velocity data is searched by the calculation of the inner product of the vector H of the rotation velocity V and the vector W of the sinusoidal wave having a different initial phase P. The phase of the velocity locus indicated by the velocity data, however, can be obtained by using other technologies.

In addition to the above, the present teaching can be applied to various control apparatuses each of which controls at least one of the rotation of a driving body by a motor and the displacement of an object which is displaced by the action or effect from the driving body.

The correspondence or correlation between the terms is as follows. The conveyance roller 31 is an exemplary driving body; the sheet Q is an exemplary object which is displaced by the action or effect from the driving body; the signal processing circuit 80 is an exemplary detector; the controller 90 is an exemplary controller. In addition to the above, the process ranging from S110 to S130 executed by the origin setting unit 95 is an exemplary data generation process; the process of S140 is an exemplary removal process; and the process ranging from S150 to S230 is an exemplary phase specifying process. The processes executed by the target setting unit 91 and the position controller 93 are examples of a main control process. The expression for calculating the error variation amount ΔY is an exemplary conveyance amount correspondence relation.

What is claimed is:

1. A control apparatus comprising:

a motor;

a driving body configured to rotate around a rotational axis by the motor;

a rotary encoder including a disk and a sensor, the disk being fixed to the driving body in a state of being eccentric to the rotational axis of the driving body; and being configured to rotate with the driving body, and the sensor being configured to read a scale of the disk and to output a pulse signal depending on rotation of the disk;

a detector configured to detect a rotation position and a rotation velocity of the disk based on the pulse signal outputted from the sensor; and a controller, wherein the controller is configured to perform:

a data generation process of controlling the motor to make the driving body turn at least one rotation and generating velocity data based on the rotation position and the rotation velocity of the disk which are detected by the detector during the at least one rotation of the driving body, the velocity data indicating a locus of the rotation velocity with respect to the rotation position;

a phase specifying process of specifying a position-phase relation, which is a correspondence relation between the rotation position of the disk and a rotation phase of the driving body, by detecting a phase, of a periodic velocity component of the locus indicated by the velocity data with respect to the rotation position of the disk, the phase of the periodic velocity component corresponding to the rotation phase of the driving body; and a main control process of controlling at least one of the rotation of the driving body and displacement of an object, which is displaced by action from the driving body, by driving the motor based on the position-phase relation specified by the phase specifying process.

2. The control apparatus according to claim 1, wherein in the data generation process, the controller is configured to:

control the motor to rotate the driving body at a constant velocity; and generate the velocity data indicating the locus during the rotation of the driving body at the constant velocity.

3. The control apparatus according to claim 2, wherein in the phase specifying process, the controller is configured to specify the position-phase relation by detecting a phase of a sinusoidal wave with respect to the rotation position, the sinusoidal wave having the same period as the rotation period of the driving body and matching the locus.

4. The control apparatus according to claim 3, wherein in the phase specifying process, the controller is configured to:

search a sinusoidal wave, which has the same period as the rotation period of the driving body and which makes an inner product of the sinusoidal wave and the locus maximum, as the sinusoidal wave matching the locus, while deviating an initial phase of the sinusoidal wave; and specify the position-phase relation based on the initial phase of the sinusoidal wave which makes the inner product maximum.

5. The control apparatus according to claim 2, wherein the controller is configured to further perform a removal process of removing a direct-current component from the locus indicated by the velocity data, and in the phase specifying process, the controller is configured to detect the phase based on the locus from which the direct-current component is removed in the removal process.

6. The control apparatus according to claim 5, wherein in the removal process, the controller is configured to:

calculate an average value of a plurality of rotation velocities at a plurality of rotation positions, the rotation velocities constituting the locus; and remove the direct-current component from the locus by subtracting the average value from each of the rotation velocities.

7. The control apparatus according to claim 6, wherein in the data generation process, the controller is configured to generate the velocity data in which the rotation velocities are correlated with the rotation positions respectively, in the removal process, the controller is configured to generate velocity data after removal of the direct-current component by removing the direct-current component from each of the rotation velocities constituting the locus, and in the phase specifying process, the controller is configured to detect a phase of a sinusoidal wave matching the locus with respect to the rotation position of the disk, by repeatedly performing a process of calculating an inner product of the sinusoidal wave and the locus indicated by the velocity data, from which the direct-current component is removed, while deviating an initial phase of the sinusoidal wave over a range of the rotation position which corresponds to at least one rotation of the driving body.

8. The control apparatus according to claim 1, wherein the driving body is a roller configured to convey a sheet in a direction perpendicular to the rotational axis of the roller, and in the main control process, the controller is configured to:

set a target value of the rotation position which corresponds to a target conveyance amount of the sheet, based on the position-phase relation; and control the motor so that the rotation position detected by the detector is varied to have the target value, thereby conveying the sheet by the target conveyance amount.

9. The control apparatus according to claim 8, wherein the controller is configured to store a conveyance amount correspondence relation which is a correspondence relation between a rotation phase of the roller and a conveyance amount of the sheet, which is brought about under a condition that the roller rotates from the rotation phase by an amount corresponding to one unit of the rotation position of the disk, and in the main control process, the controller is configured to set the target value corresponding to the target conveyance amount of the sheet by specifying a conveyance amount of the sheet over a range from an initial position, which is the rotation position of the disk at the time of starting conveyance of the sheet, to the target value, based on the position-phase relation and the conveyance amount correspondence relation.

10. The control apparatus according to claim 9, wherein in the main control process, the controller is configured to:

set, as a temporary target value, the target value of the rotation position of the disk corresponding to the target conveyance amount which is brought about under a condition that the disk is fixed to the driving body in a state that there is no eccentricity to the rotational axis of the driving body; and set the target value of the rotation position of the disk by correcting the temporary target value according to the conveyance amount correspondence relation so as to make an error between the target conveyance amount and a conveyance amount of the sheet over a range from the initial position to the temporary target value zero.

11. An image forming system comprising:

the control apparatus according to claim 8, and an image forming mechanism configured to form an image on the sheet conveyed by the roller of the control apparatus.

* * * * *